US010711228B2

(12) United States Patent
Lee et al.

(10) Patent No.: US 10,711,228 B2
(45) Date of Patent: Jul. 14, 2020

(54) SUBSTRATE TREATING APPARATUS AND SUBSTRATE TREATING METHOD

(71) Applicant: SEMES CO., LTD., Chungcheongnam-do (KR)

(72) Inventors: Mong-Ryong Lee, Gyeonggido (KR); Miyoung Jo, Busan (KR); Yerim Yeon, Hwaseong-si (KR); Anton Koriakin, Chungcheongnam-do (KR)

(73) Assignee: SEMES CO., LTD., Chungcheongnam-Do (KR)

( * ) Notice: Subject to any disclaimer, the term of this patent is extended or adjusted under 35 U.S.C. 154(b) by 0 days.

(21) Appl. No.: 16/028,720

(22) Filed: Jul. 6, 2018

(65) Prior Publication Data

US 2019/0010430 A1 Jan. 10, 2019

(30) Foreign Application Priority Data

Jul. 10, 2017 (KR) ..... 10-2017-0087073

(51) Int. Cl.

| | |
|---|---|
| ***C11D 11/00*** | (2006.01) |
| ***C11D 17/00*** | (2006.01) |
| ***C11D 3/43*** | (2006.01) |
| ***C11D 3/37*** | (2006.01) |

(52) U.S. Cl.

CPC ..... *C11D 11/0047* (2013.01); *C11D 3/37* (2013.01); *C11D 3/3707* (2013.01); *C11D 3/378* (2013.01); *C11D 3/43* (2013.01); *C11D 17/0013* (2013.01)

(58) Field of Classification Search

None

See application file for complete search history.

(56) References Cited

U.S. PATENT DOCUMENTS

| | | | |
|---|---|---|---|
| 8,367,594 B2 | 2/2013 | Mikhaylichenko | |
| 2014/0041685 A1* | 2/2014 | Kaneko | H01L 21/02041 134/4 |

FOREIGN PATENT DOCUMENTS

| | | | |
|---|---|---|---|
| KR | 10-2011-0093995 | A | 8/2011 |
| KR | 10-2011-0095250 | A | 8/2011 |
| KR | 10-2012-0004451 | A | 1/2012 |
| KR | 10-2012-0109999 | A | 10/2012 |
| KR | 10-2014-0019741 | A | 2/2014 |
| KR | 10-2014-0140053 | A | 12/2014 |

* cited by examiner

*Primary Examiner* — Eric W Golightly

(74) *Attorney, Agent, or Firm* — Li & Cai Intellectual Property (USA) Office

(57) ABSTRACT

Disclosed are a substrate treating apparatus and a substrate treating method. The substrate treating apparatus includes a support member which supports a substrate; a treatment liquid discharging member which discharges a treatment liquid containing a monomeric substance to the substrate located in the support member; and a light irradiator which irradiates light to the treatment liquid discharged to the substrate.

4 Claims, 6 Drawing Sheets

SUBSTRATE TREATING APPARATUS AND SUBSTRATE TREATING METHOD

CROSS-REFERENCE TO RELATED APPLICATIONS

This application claims priority under 35 U.S.C. § 119 to Korean Patent Application No. 10-2017-0087073 filed on Jul. 10, 2017, in the Korean Intellectual Property Office, the disclosures of which are incorporated by reference herein in their entireties.

BACKGROUND

Embodiments of the inventive concept described herein relate to a substrate treating apparatus and a substrate treating method, and more particularly to an apparatus and a method for cleaning a substrate.

Contaminants such as particles, organic contaminants, and metallic contaminants on a surface of a substrate greatly influence the characteristics and yield rate of a semiconductor device. Due to this, a cleaning process of removing various contaminants attached to a surface of a substrate is very important in a semiconductor manufacturing process, and a process of cleaning a substrate is performed before and after unit processes for manufacturing a semiconductor.

The particles that are detached from the substrate in the cleaning process may be attached to the substrate again, and may be left on the substrate after the cleaning process is completed. Further, as the semiconductor process becomes finer, the sizes of the particles generated in the process also become smaller. The small-sized particles may not be smoothly cleaned and may be left on the substrate even after the cleaning process is performed.

SUMMARY

Embodiments of the inventive concept provide a substrate treating apparatus that may efficiently treat a substrate, and a substrate treating method.

Embodiments of the inventive concept also provide a substrate treating apparatus that may smoothly clean particles of fine sizes, and a substrate treating method.

Embodiments of the inventive concept also provide a substrate treating apparatus that may prevent particles, which are detached from a substrate in a cleaning process, from being attached to a substrate again, and a substrate treating method.

Embodiments of the inventive concept also provide a substrate treating apparatus that has a short process executing time, and a substrate treating method.

In accordance with an aspect of the inventive concept, there is provided a substrate treating method including applying a treatment liquid containing a monomeric substance to a substrate that is intended to be cleaned, curing the treatment liquid with a cleaning film by irradiating light to the treatment liquid and polymerizing the monomeric substance, and removing the cleaning film.

The cleaning film may have a net structure that is formed by polymerizing the monomeric substance.

A solvent for the treatment liquid may be water.

The light may have a wavelength of an ultraviolet ray band.

The treatment liquid may include a photo initiator.

The monomeric substance may form an acrylate-based compound through a polymerization.

In accordance with another aspect of the inventive concept, there is provided a substrate treating apparatus including a support member configured to support a substrate, a treatment liquid discharging member configured to discharge a treatment liquid containing a monomeric substance to the substrate located in the support member, and a light irradiator configured to irradiate light to the treatment liquid discharged to the substrate.

The light irradiator may irradiate light to an area between the center of rotation of the substrate and an outer end of the substrate.

The light irradiator may irradiate light such that the light passes through the center of rotation of the substrate and the light is irradiated over an area between one end and an opposite end of the substrate.

The substrate treating apparatus may further include a cleaning film remover configured to remove a cleaning film formed when the treatment liquid is cured by the light from the substrate.

BRIEF DESCRIPTION OF THE FIGURES

The above and other objects and features of the inventive concept will become apparent by describing in detail exemplary embodiments thereof with reference to the accompanying drawings.

DETAILED DESCRIPTION

Hereinafter, exemplary embodiments of the inventive concept will be described in more detail with reference to the accompanying drawings. The embodiments of the inventive concept may be modified in various forms, and the scope of the inventive concept should not be construed to be limited to the following embodiments. The embodiments of the inventive concept are provided to describe the inventive concept for those skilled in the art more completely. Accordingly, the shapes of the components of the drawings are exaggerated to emphasize clearer description thereof.

Figure 1:
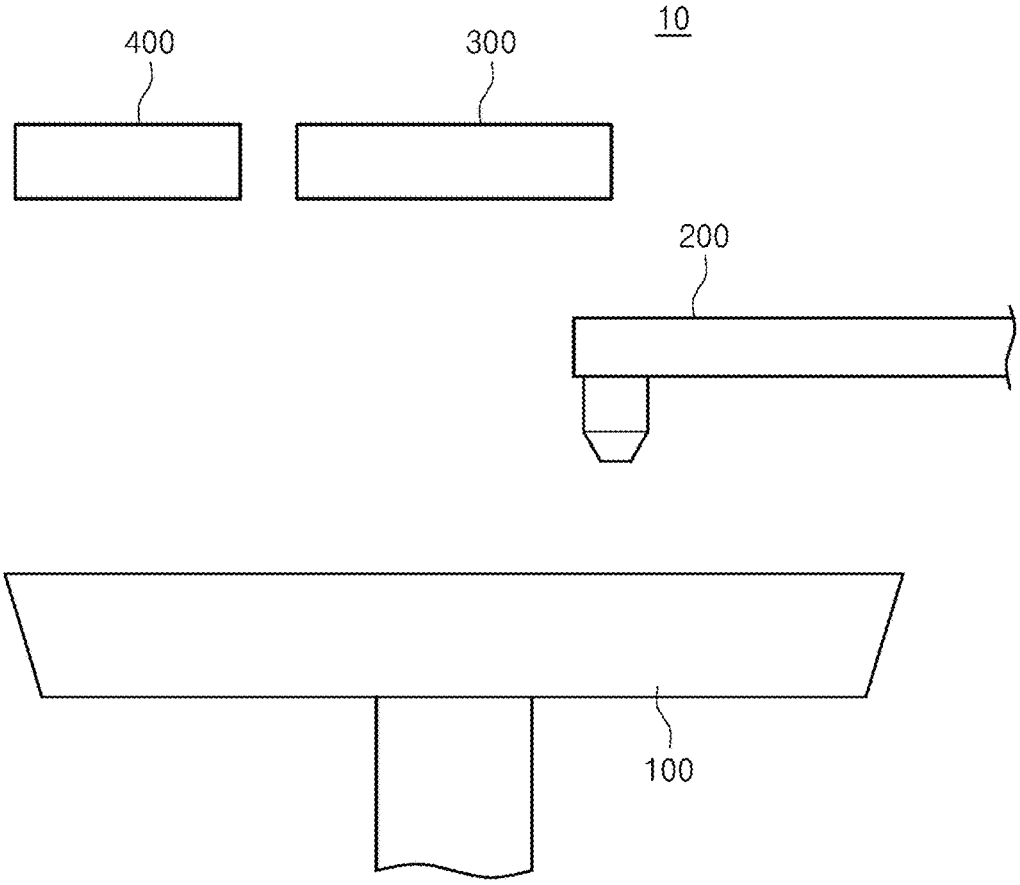
FIG. 1 is a view illustrating a substrate treating apparatus according to an embodiment of the inventive concept.

FIG. 1 is a view illustrating a substrate treating apparatus according to an embodiment of the inventive concept.

Referring to FIG. 1, the substrate treating apparatus 10 includes a support member 100, a treatment liquid discharging member 200, a light irradiator 300, and a cleaning film remover 400.

An upper side of the support member 100 has a plate shape having a preset thickness to support a substrate S during execution of a process. As an example, the support member 100 may be provided with a pin for supporting the substrate S to support the substrate S during execution of the process. As another example, the support member 100 may support the substrate S during execution of the process in a vacuum absorption scheme. The support member 100 may be provided to be rotatable while supporting the substrate S.

The treatment liquid discharging member 200 discharges a treatment liquid to the substrate S located in the support member 100. The treatment liquid is provided in a state in which a monomeric substance of a preset compound is dissolved in a solvent. As an example, the treatment liquid may include one of a monomer, a dimer, and an oligomer. As an example, the treatment liquid may include two or more of a monomer, a dimer, and an oligomer. The preset compound is one that is polymerized if light is irradiated to the monomeric substance. The polymerization may be a light curing reaction or a radical polymerization. For example, the preset compound may be an acrylate-based compound that is formed through a polymerization of ester (ethyl acrylate, methyl acrylate, or methyl methacrylate) or salt (sodium acrylate or ammonium acrylate). In addition, the preset compound may be acryl, acrylate, an unsaturated group, polyvinyl pirrolidone (PVP), ethylene glycol methacrylate, butyl acrylate, or polyethylene glycol diacrylate (PEGDA). The solvent may be water. The treatment liquid is such that a monomeric substance is added to the solvent that is water, and a time for manufacturing the treatment liquid may be short unlike the case in which a high-molecular substance is dissolved in the solvent. Further, the viscosity of the treatment liquid is similar to that of water because the solvent is water so that the treatment liquid may be easily controlled in a process of discharging the treatment liquid to the substrate S.

A photo initiator may be added to the treatment liquid (PL) such that the polymerization of the monomeric substance may be expedited as the irradiated light is absorbed by the treatment liquid.

The light irradiator 300 irradiates light to the substrate S located in the support member 100. The light irradiated by the light irradiator 300 may have a wavelength of an ultraviolet ray band. The light irradiator 300 may irradiate light over an area between the center of rotation of the substrate S and an outer end of the substrate S. Accordingly, if the substrate S is rotated while the light irradiator 300 irradiates light, the light may be irradiated over a whole upper surface area of the substrate S. As another example, the light irradiator 300 may irradiate light such that the light passes through the center of rotation of the substrate S and the light is irradiated over an area between one end to an opposite end of the substrate S. Accordingly, if the substrate S is rotated while the light irradiator 300 irradiates light, the light may be irradiated over a whole upper surface area of the substrate S. As another example, the light irradiator 300 may irradiate light such that the light travels in an area between the center of rotation of the substrate S and an outer end of the substrate S. Accordingly, if the substrate S is rotated while the light irradiator 300 irradiates light, the light may be irradiated over a whole upper surface area of the substrate S.

The cleaning film remover 400 removes a cleaning film L formed in the substrate S. The cleaning film remover 400 is provided to be movable vertically. Further, the cleaning film remover 400 may be provided to be movable forwards and rearwards or leftwards and rightwards. The cleaning film remover 400 is provided such that a negative pressure is formed on a lower surface thereof.

Figure 2:
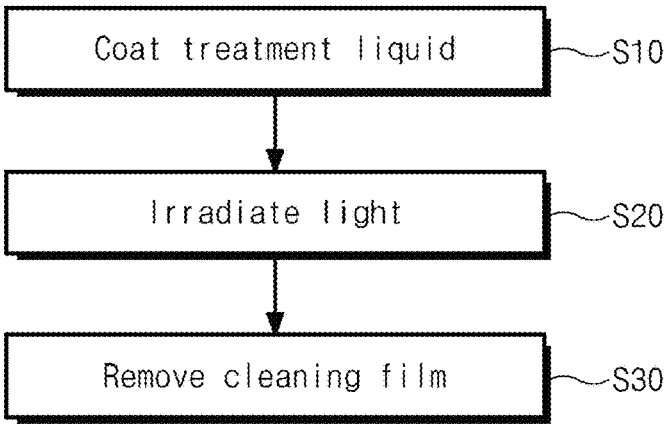
FIG. 2 is a block diagram illustrating a step of cleaning a substrate.
Figure 3:
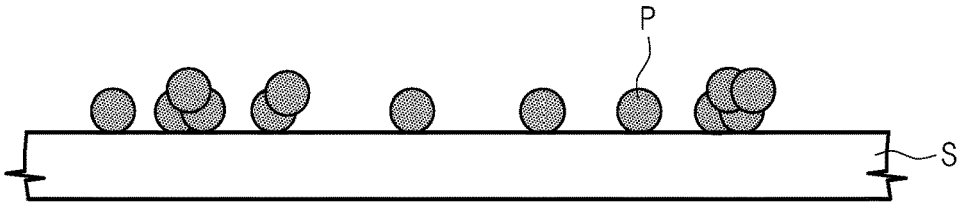
FIG. 3 (RELATED ART)
FIG. 3 is a view illustrating a state of a substrate provided for cleaning.

FIG. 2 is a block diagram illustrating an step of cleaning a substrate. FIG. 3 is a view illustrating a state of a substrate provided for cleaning.

Referring to FIGS. 2 and 3, the substrate treating apparatus 10 cleans a substrate S. The substrate S is provided while particles P are present on an upper surface of the substrate S. The particles P are side-products generated in the previous processes, such as a lithographic process, an etching process, and a mechanical/chemical polishing process. Accordingly, the following processes need to be performed on the substrate S after the particles P are removed.

Figure 4:
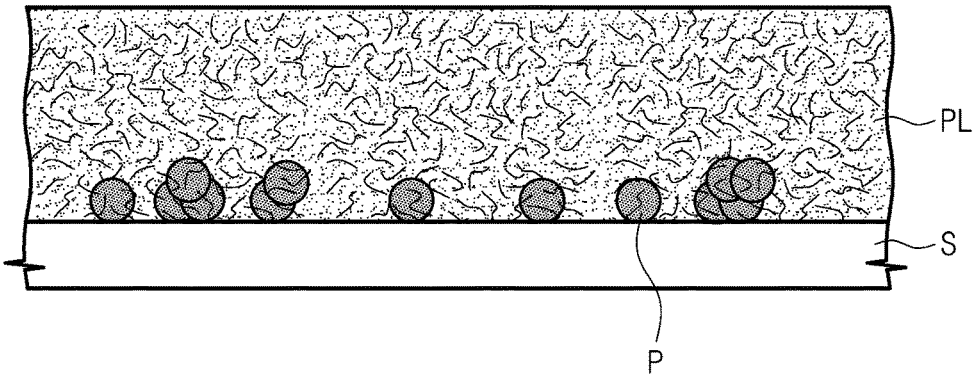
FIG. 4 is a view illustrating a substrate in a state in which a treatment liquid is discharged.

FIG. 4 is a view illustrating a substrate in a state in which a treatment liquid is discharged.

Referring to FIG. 4, if the substrate S is located in the support member 100, the treatment liquid discharging member 200 discharges a treatment liquid to the substrate S (S10). The support member 100 may be rotated when the treatment liquid is discharged to help apply the treatment liquid over the whole upper surface of the substrate S.

Figure 5:
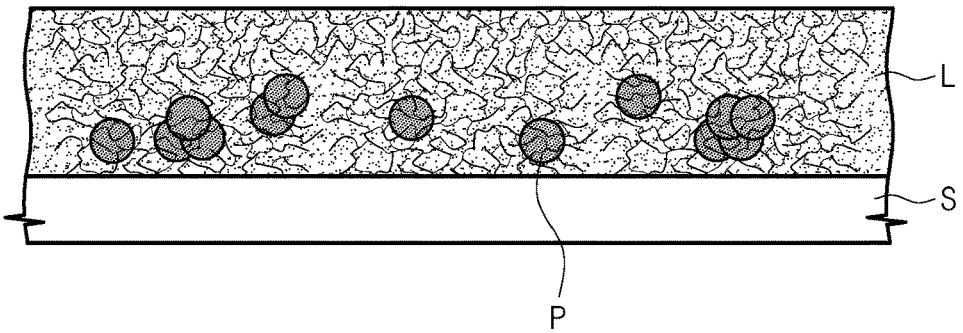
FIG. 5 is a view illustrating a state in which a cleaning film is formed in a substrate.
Figure 6:
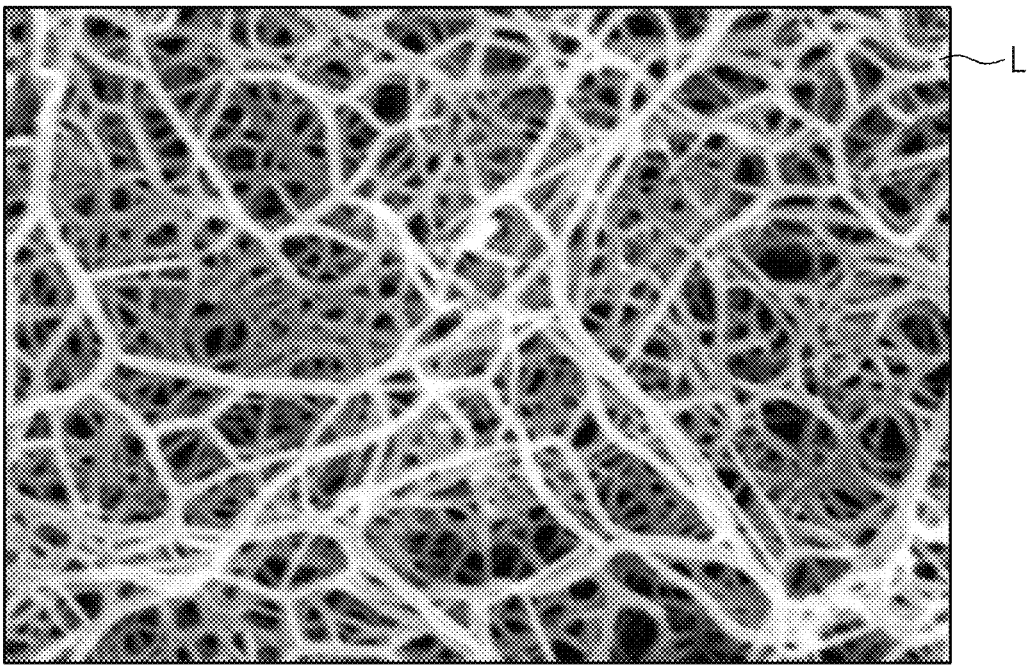
FIG. 6 is a view illustrating a structure of a cleaning film.

FIG. 5 is a view illustrating a state in which a cleaning film is formed in a substrate. FIG. 6 is a view illustrating a structure of a cleaning film.

Referring to FIGS. 5 and 6, if the treatment liquid of a preset amount is discharged, the light irradiator 300 irradiates light to the substrate S (S20). If light is irradiated, the treatment liquid (PL) forms a cleaning film L as the solvent is vaporized and cured. Because the solvent is water, the solvent may be completely vaporized and the treatment liquid may be completely cured within several seconds after the irradiation of the light is started. Further, because a time for forming the cleaning film L is short, a thermal change of the substrate S due to heat transferred to the substrate S is prevented.

If the light is irradiated, the monomeric substance contained in the treatment liquid generates a polymerization to form a compound. If adjacent monomeric substances are polymerized, the compound forms a three-dimensional net structure. Accordingly, the particles P located between the monomeric substances are collected by the cleaning film L while being located in the three-dimensional net structure.

Figure 7:
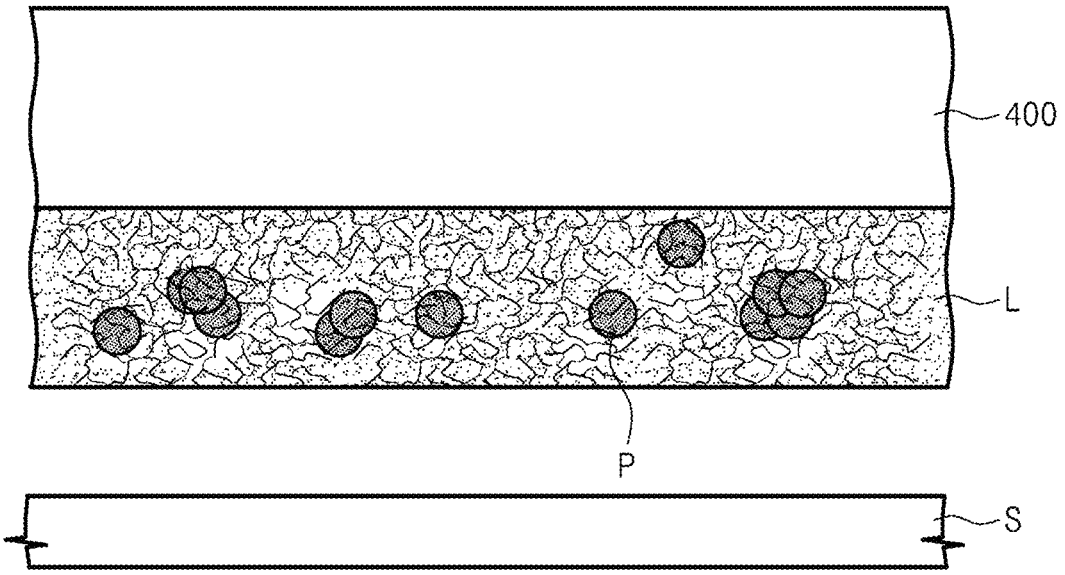
FIG. 7 is a view illustrating a state in which a cleaning film is removed.

FIG. 7 is a view illustrating a state in which a cleaning film is removed.

Referring to FIG. 7, thereafter, the cleaning film remover 400 provides a negative pressure to the cleaning film to remove the cleaning film L that collects the particles P from the substrate S (S30).

The substrate treating apparatus 10 according to the inventive concept removes the particles P together with the cleaning film L in a state in which the particles P are collected by the three-dimensional net structure formed in the cleaning film L. The three-dimensional net structure has a very dense structure of several nanometers because it is formed by a polymerization of monomeric substances of small molecules. Further, the lengths of the monomeric substances contained in the cleaning liquid may be adjusted in consideration of the sizes of the particles P that are intended to be cleaned.

Accordingly, even the fine particles P having sizes of several nanometers to several tens of nanometers are removed together with the cleaning film L in a state in which the particles P are prevented from being separated from the cleaning film L after being collected by the cleaning film L. Accordingly, the particles P are prevented from being attached to the substrate again in the cleaning process.

Further, according to the inventive concept, the substrate S may be cleaned in a short time because a time for forming a cleaning film in a hydrogel form by irradiating light to the treatment liquid is as short as several seconds.

Figure 8:
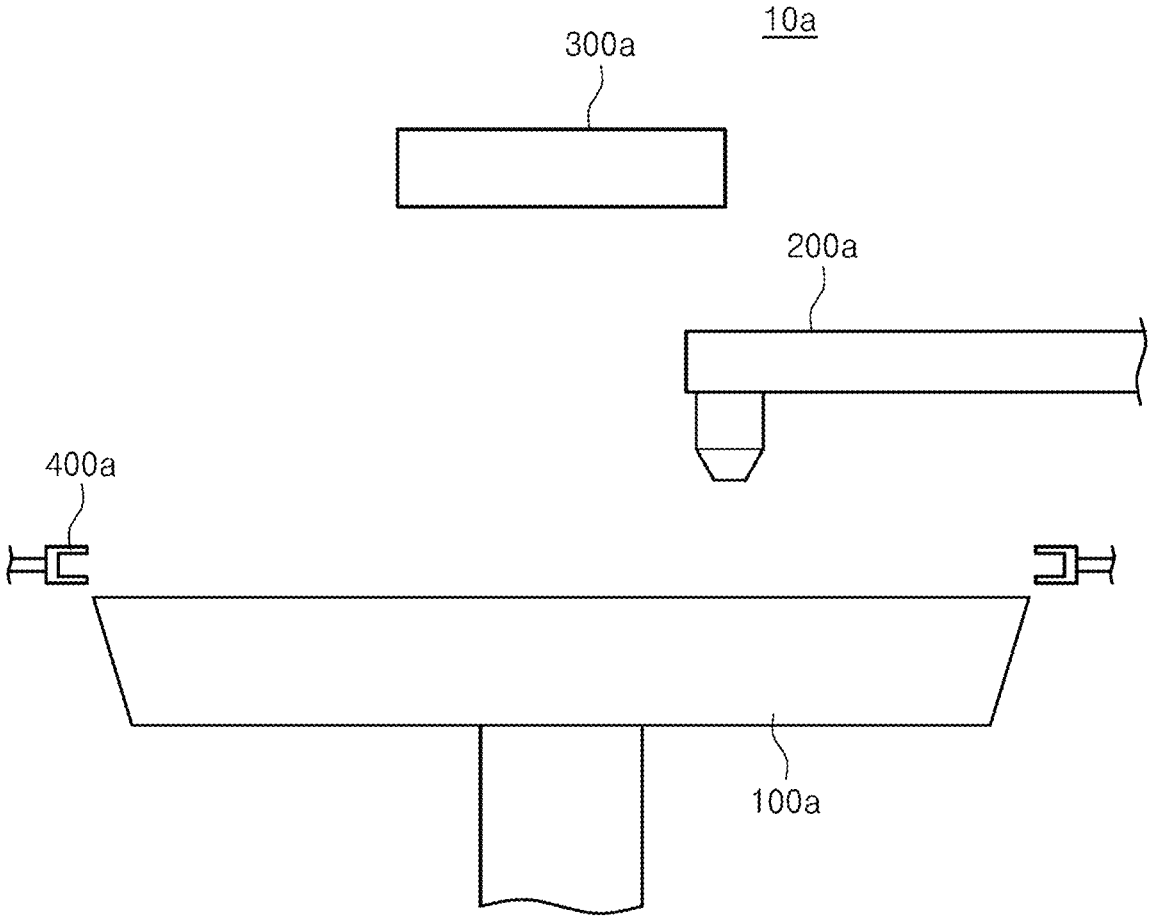
FIG. 8 is a view illustrating a substrate treating apparatus according to another embodiment of the inventive concept.

FIG. 8 is a view illustrating a substrate treating apparatus according to another embodiment of the inventive concept.

Referring to FIG. 8, the substrate treating apparatus 10*a* includes a support member 100*a*, a treatment liquid discharging member 200*a*, a light irradiator 300*a*, and a cleaning film remover 400*a*.

Because the configurations and functions of the support member 100*a*, the treatment liquid discharging member 200*a*, and the light irradiator 300*a* are the same as those of the substrate treating apparatus 10 of FIG. 1, a repeated description thereof will be omitted.

The cleaning film remover 400*a* removes a cleaning film L formed in the substrate S. One or more cleaning film removers 400*a* may be provided at locations corresponding to an outer circumference of the substrate S. The cleaning film removers 400*a* are provided to be movable vertically. Further, the cleaning film removers 400*a* may be provided to be movable forwards and rearwards or leftwards and rightwards. The cleaning film removers 400*a* are provided in a clipable form of the cleaning film L.

Figure 9:
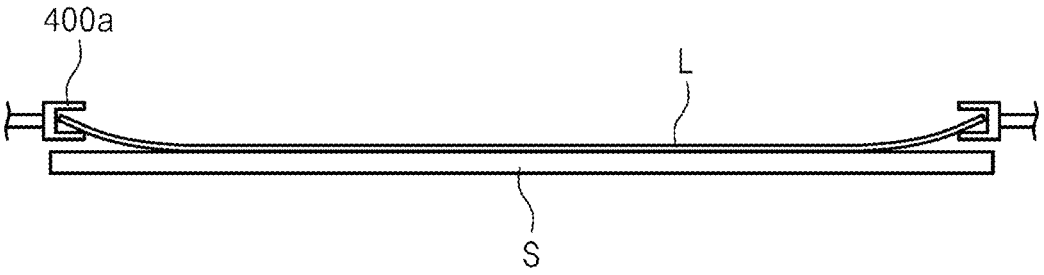
FIG. 9 is a view illustrating a state in which a cleaning film is being removed.

FIG. 9 is a view illustrating a state in which a cleaning film is being removed.

Referring to FIG. 9, an aperture is formed between an outer circumference of the substrate S and an outer circumference of the cleaning film L. The treatment liquid is cured while collecting particles if light is irradiated after the treatment liquid is applied to the substrate S. The curing speeds of an upper side and a lower side of the cleaning film L are different in the curing process, and accordingly, a force, by which the cleaning film L is lifted, is applied to an outer circumference of the cleaning film L. Accordingly, the cleaning film remover 400*a* may grip the cleaning film L through the aperture formed at the outer circumference of the cleaning film L. Thereafter, the cleaning film remover 400*a* may be moved upwards to remove the cleaning film L from the substrate S.

According to an embodiment of the inventive concept, a substrate treating apparatus that efficiently treats a substrate and a substrate treating method may be provided.

Further, according to an embodiment of the inventive concept, a substrate treating apparatus that smoothly cleans particles of fine sizes and a substrate treating method may be provided.

According to an embodiment of the inventive concept, a substrate treating apparatus that may prevent particles, which are detached from a substrate in a cleaning process, from being attached to a substrate again, and a substrate treating method may be provided.

According to an embodiment of the inventive concept, a substrate treating apparatus that has a short process executing time and a substrate treating method may be provided.

The above description exemplifies the inventive concept. Furthermore, the above-mentioned contents describe the exemplary embodiment of the inventive concept, and the inventive concept may be used in various other combinations, changes, and environments. That is, the inventive concept can be modified and corrected without departing from the scope of the inventive concept that is disclosed in the specification, the equivalent scope to the written disclosures, and/or the technical or knowledge range of those skilled in the art. The written embodiment describes the best state for implementing the technical spirit of the inventive concept, and various changes required in the detailed application fields and purposes of the inventive concept can be made. Accordingly, the detailed description of the inventive concept is not intended to restrict the inventive concept in the disclosed embodiment state. Furthermore, it should be construed that the attached claims include other embodiments.

What is claimed is:

1. A substrate treating apparatus comprising:

a support member configured to support a substrate;

a treatment liquid discharging member configured to discharge a treatment liquid containing a monomeric substance to the substrate located in the support member;

a light irradiator configured to irradiate light to the treatment liquid discharged to the substrate; and cleaning film removers configured to remove a cleaning film formed when the treatment liquid is cured by the light from the substrate, wherein the cleaning film removers are clips arranged at locations corresponding to an outer circumference of the substrate.

2. The substrate treating apparatus of claim 1, wherein the light irradiator irradiates light to an area between the center of rotation of the substrate and an outer end of the substrate.

3. The substrate treating apparatus of claim 1, wherein the light irradiator irradiates light such that the light passes through the center of rotation of the substrate and the light is irradiated over an area between one end and an opposite end of the substrate.

4. The substrate treating apparatus of claim 1, wherein the cleaning film removers are configured to be movable vertically, forwards, rearwards or leftwards and rightwards when removing the cleaning film.

* * * * *